US005621991A

United States Patent [19]

Gustafson

[11] Patent Number: 5,621,991

[45] Date of Patent: Apr. 22, 1997

[54] LIGHTED DISPLAY WITH ELECTROLUMINESCENT LAMPS

[75] Inventor: Thomas L. Gustafson, Southfield, Mich.

[73] Assignee: Stan-Tech, Dearborn, Mich.

[21] Appl. No.: 550,713

[22] Filed: Oct. 31, 1995

[51] Int. Cl.[6] ..... G09F 13/22

[52] U.S. Cl. ..... 40/544; 40/552; 362/84; 362/812

[58] Field of Search ..... 40/544, 552; 362/84, 362/250, 812

[56] References Cited

U.S. PATENT DOCUMENTS

| | | | |
|---|---|---|---|
| 2,220,618 | 11/1940 | Tschopp . | |
| 3,161,974 | 12/1964 | Blockson . | |
| 3,404,475 | 10/1968 | Coad | 40/552 |
| 4,028,828 | 6/1977 | Chao et al. | 40/552 |
| 4,327,511 | 5/1982 | Rodriquez . | |
| 4,733,488 | 3/1988 | Yokoyama et al. . | |
| 4,918,578 | 4/1990 | Thompson . | |
| 4,999,936 | 3/1991 | Calamia et al. | 40/544 |
| 5,336,345 | 8/1994 | Gustafson et al. . | |
| 5,406,463 | 4/1995 | Schexnayder, Sr. . | |
| 5,433,024 | 7/1995 | Lerner . | |

FOREIGN PATENT DOCUMENTS

| | | | |
|---|---|---|---|
| 2044506 | 10/1980 | United Kingdom | 40/552 |

*Primary Examiner*—Brian K. Green
*Attorney, Agent, or Firm*—Harness, Dickey & Pierce, P.L.C.

[57] ABSTRACT

An electroluminescent lamp and associated method for manufacturing the same having coplanar contact pads, thereby allowing the lamp to be positioned at any point along a conductive bus bar. The lamp includes a base nonconductive film having an electrically conductive coating. A first layer of illuminative material is screen printed on to the base film. A second layer of insulative material is applied over the first layer of illuminative material. A third layer comprised of a conductive ink coating is then screen printed over the second layer of insulative material in inlaid fashion. An insulative coating is then applied over the third layer of conductive material to effectively seal the first, second, and third layers between the base nonconductive film and the insulative coating. First and second coplanar contact pads are then formed on the lamp for electrically connecting the lamp to a power supply. The first electrical conductive contact pad is electrically connected to the base film conductive coating. The second electrically conductive contact pad is electrically connected to the third layer of the conductive ink coating. The contact pads are coplanar such that the EL lamp may be inserted into a bus bar to electrically connect the contact pads with the bus wires. The lamp may be inserted to one of two or more positions in the bus bar to create alternative lighting sequences, such as constant, flashing, or running illumination sequences.

14 Claims, 3 Drawing Sheets

LIGHTED DISPLAY WITH ELECTROLUMINESCENT LAMPS

BACKGROUND OF THE INVENTION

The present invention relates generally to electroluminescent lighting technology and, more particularly, to a display on which electroluminescent lamps with coplanar printed contact pads electrically connect the lamp with a continuous bus bar at any point along the length of the bus bar.

Electroluminescent (EL) lighting technology provides a desirable source of illumination for several reasons. First, EL lamps emit a coherent light having a relatively low level of glare when compared to incandescent lamps, fluorescent lamps or other lamps using conventional lighting technologies. Second, EL lamps operate on a relatively low level of power when compared to lamps incorporating the aforementioned lighting technologies, and thus are less expensive to operate. Third, EL lamps have thickness profiles typically of only a few thousandths of an inch, thus permitting these lamps to be used in applications where lamps having thicker profiles could not be used. Fourth, due to the recent advancements in EL lighting technology, EL lamps exhibit longevity of operational life and thus need not be replaced as often as lamps incorporating conventional lighting technologies.

The extended operational life of conventional EL lamps mentioned above has been primarily due to the microencapsulation of phosphor particles to emit light. The microencapsulation of the phosphor particles protects the particles from moisture that, if allowed to penetrate the EL lamp protective barrier and contact the phosphor particles, would diminish the ability of the particles to emit light. One traditional method of protecting the phosphor particles from moisture ingress is to laminate the particles between two sheets of polychlortrifloroethylene (PCTFE). By sealing the phosphor particles between the PCTFE sheets, the ability of moisture to penetrate through to the phosphor particles is greatly reduced.

However, the above mentioned lamination process suffers from two major drawbacks. First, in order to effectively prevent moisture ingress, the laminated PCTFE sheets must maintain a seal around the periphery of the sheets in order to remain effective. This seal, however, often deteriorates over a period of time and when exposed to repeated frictional forces or other similar adverse conditions. Second, the EL lamp construction requires that electrical connection points be established with the lamp through wires, connector pins, or contact pads. Such electrical connections require that the PCTFE sheets be punctured or the seal between the sheets be compromised in order to make the electrical connections. Both such situations compromise the water tight seal and typically lead to decreased lamp life and lighting effectiveness.

The above mentioned drawbacks associated with EL lamination techniques have been largely eliminated through the use of a screen printing process utilizing microencapsulated phosphors in forming screen printed EL lamps. By forming EL lamps through this screen printing process, wires, crimp pins and contact printed pads are implemented without puncturing, piercing or otherwise compromising the moisture barrier encapsulating the phosphor particles.

While the above described lamination process has eliminated many of the drawbacks associated with the EL lamp lamination process, areas remain within the art where technological advancement would be desirable. For example, with conventional EL lamps manufactured through the above described screen printing process, typically the wires, crimp pins or contact pads connecting the encapsulated lamp with the power source require that the graphic be snap fit or correctly aligned with power source sockets or receptacles in order to illuminate the associated lamp graphics. Thus, the EL lamps may only be connected in display areas in which the power source sockets or receptacles are located, thereby limiting flexibility in lamp arrangement. In addition, to achieve alternate lighting configurations, i.e., a continuous lighted sequence, a flashing lighted sequence or a running lighted sequence, circuitry associated with the power source must typically be altered or switched.

Therefore, a need exists for an EL lamp, and associated method for manufacturing the same, that may be located at any point along a continuous conducting surface such as a bus bar. There also exists a need for an EL lamp which allows a person installing the lamp to control the lighting characteristics of the lamp through selective placement of the lamp without having to switch or otherwise alter the power supply or associated circuitry. Further, there exists a need for an EL lamp having electrical contact pads that prevent shorting of the EL system display if the lamp is misaligned during insertion into the display. In addition, there exists a need for a method of forming an EL lamp in which electrical contact pads are formed coplanar to one another to allow the associated EL graphics to be manipulated as described above.

SUMMARY OF THE INVENTION

Accordingly, the present invention relates to a display utilizing EL lamps that may be located at any point along a continuous conducting bus bar surface. EL lamps utilized with the display may be electrically connected to the conducting surface in various manners to thereby control the lighting characteristics of the EL lamps without having to switch or otherwise alter the power supply or associated power supply circuitry. In addition, an EL lamp according to the present invention is formed with electrical contact pads that are longitudinally offset relative to and coplanar with one another, thereby allowing the lamps to be easily manipulated while minimizing the chance of short circuiting the display.

A multi-layer EL lamp according to the preferred embodiment of the present invention includes a base nonconductive film with an electrically conductive coating. A first layer of illuminative material, such as phosphor matrix, is screen printed onto the base film. A second layer of insulative material is applied over the first layer of illuminative material. A third layer composed of a conductive ink coating is screen printed over the layer of insulative material in inlaid fashion. An insulative coating is then applied over the first, second and third layers to effectively seal the layers between the base nonconductive film and the insulative coating. First and second conductive contact pads are then added for electrical connection of the lamp to a power supply. The first conductive contact pad connects the base nonconducting film having the conductive coating to the power source, while the second conductive contact pad connects the third layer of conductive ink coating to the power source. The multi-layer EL lamp thus formed functions as a lossy capacitor. As a result, when the first and second conductive contact pads are connected to the power source, the lamp is energized and the first layer of illuminative material emits light.

The above described EL lamp may be incorporated into a lighted display, which includes a display support, a power supply operatively associated with the display support and a bus bar mounted to the display support and having at least two bus wires extending therealong. The bus wires are electrically connected to the power supply. When the above described EL lamp is placed in communication with the bus bar, the lamp, through its first and second contact pads, is illuminated by electricity supplied by the power source through the bus wires. The EL lamp may be placed into contact with the first and second bus wires at any point along the continuous bus wires for illumination purposes, thereby overcoming the limitation associated with earlier EL lamps requiring lamps to be positioned according to power source socket locations. In addition, the bus bar associated with the lighted display of the present invention may also have a third bus wire that allows the EL lamp to flash, rather than be continuously illuminated, when the lamp is inserted into the bar to a second depth such that the contact pads contact the second and third bus wires rather than the first and second bus wires.

These and other various advantages and features of the present invention will become apparent from the following description and claims, in conjunction with the appended drawings.

DETAILED DESCRIPTION OF THE PREFERRED EMBODIMENTS

Figure 1:
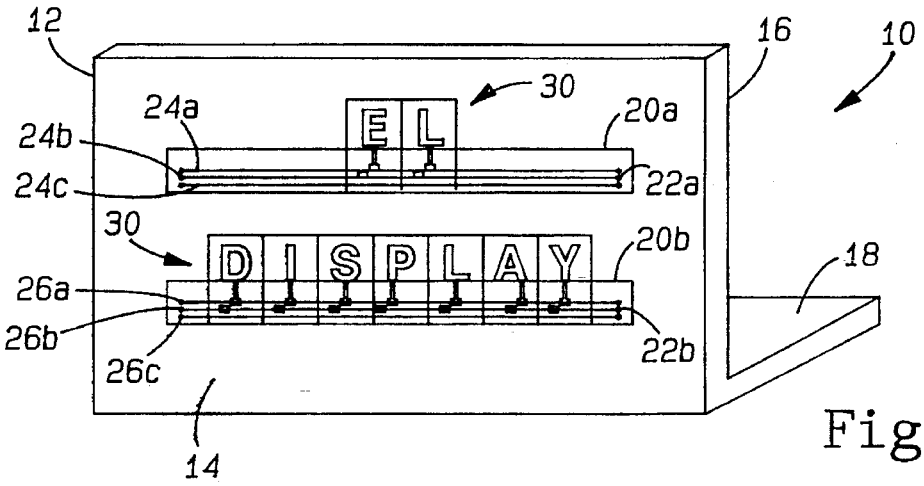
FIG. 1 is a perspective view of a lighted electroluminescent display according to a preferred embodiment of the present invention.

Referring now to the drawings, FIG. 1 shows an EL lighted display according to a preferred embodiment of the present invention generally at 10. The lighted display includes socketless EL lamp/power supply interfaces that permit easy implementation and manipulation of the EL lamps as will be described below.

Figure 2:
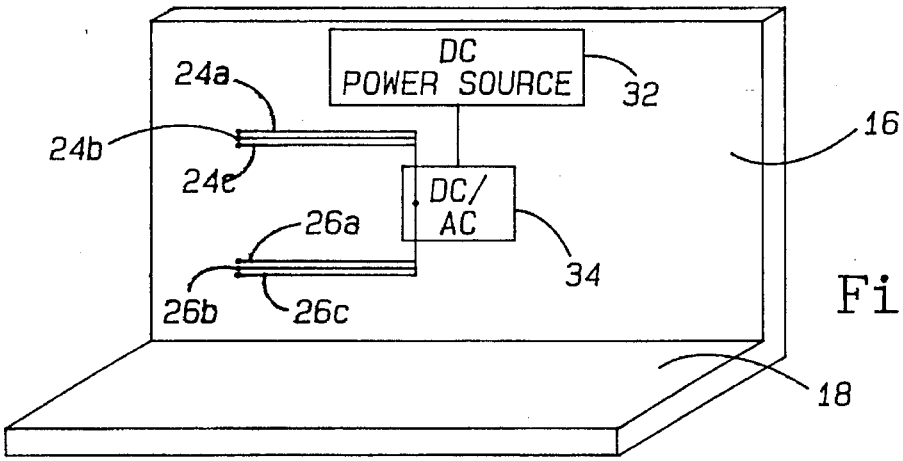
FIG. 2 is a rear perspective view of the display shown in FIG. 1.

The EL display 10 includes a letter board 12 having a front side 14 and a rear side 16. The letter board 12 also includes an associated base 18 for maintaining the board 12 in a substantially upright position. The letter board includes two U-shaped troughs 20*a*, 20*b* each including a bus bar 22*a*, 22*b*. Bus bar 22*a* includes bus wires 24*a*, 24*b*, 24*c*, while the bus bar 22*b* includes bus wires 26*a*, 26*b* and 26*c*. The aforementioned bus wires conduct electricity and provide an electrical connection between EL lamps, shown generally at 30, and the display power source 32 (FIG. 2). Thus, the EL lamps, when placed in electrical contact with two of the three bus wires at any point along the continuous respective lengths of the bus wires, are thereby illuminated.

Turning to FIG. 2, the rear surface 16 of the letter board 12 is shown. The bus wires 24*a*–24*c* and 26*a*–26*c* extend through apertures in the letter board and are connected to a DC power source 32 via a DC to AC convertor 34. In the preferred embodiment of the present invention, the DC power source is a conventional 9-volt DC battery, while the DC to AC convertor is a typical commercially available convertor that converts the battery's 9-volts DC to 30-volts AC. However, as is well known in the art, the EL lamps may be designed to function on voltages ranging from 30-volts AC to 150-volts AC at a frequency of 60 Hz to 2 KHz depending upon the particular lighting application. Alternatively, the EL display of the present invention may be implemented using power from a standard 120-volt, 60 Hz house electrical outlet.

Figure 3:
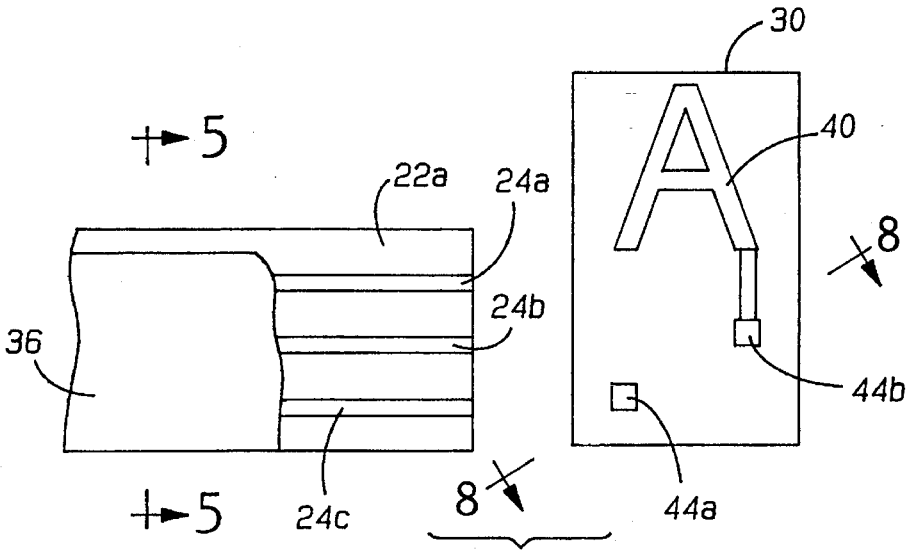
FIG. 3 is an enlarged front elevational view of the bus bar of the display and an EL lamp as shown in FIG. 1.

Referring to FIGS. 1 and 3, a bus bar facade 36 is shown partially cut-away from the bus bar 22*a*. The facade may be composed of any material that is capable of covering the bus bars 22*a*, 22*b* and the associated bus wires 24*a*–24*c* and 26*a*–26*c* to thereby aesthetically improve the appearance of the display 10. Also, as shown in FIG. 3, each individual EL lamp 30 contains graphics 40, such as an alphanumeric character. The graphics are illuminated by AC electricity provided through the connection of the aforementioned bus wires with electrical contact pads 44*a*, 44*b*. While alphanumeric characters are shown implemented in FIG. 1, it should be appreciated that any graphics design may be formed on an EL lamp according to the present invention as will be appreciated upon reading of the following description.

Figure 4:
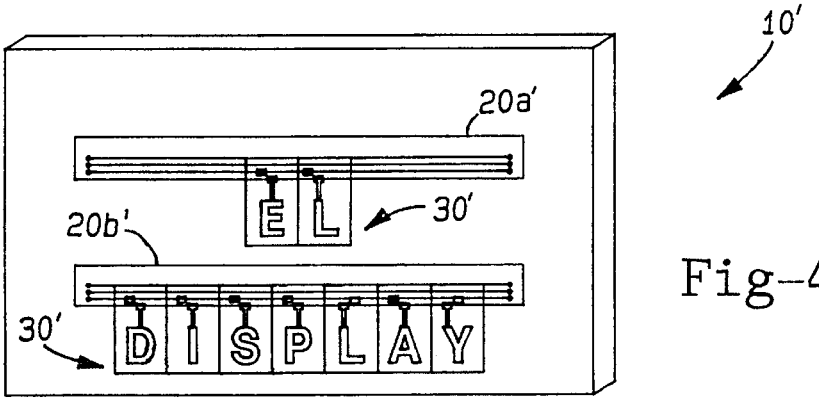
FIG. 4 is a perspective view of a display according to a second preferred embodiment of the present invention.

While the display shown at 10 includes a letter board 12 and a base 18, it should be appreciated that the display structure may vary according to the desired application without departing from the scope of the present invention. For example, the troughs could be designed to be free-standing or to be mounted on conventional movable letter boards. Alternatively, the troughs could be interconnected with wires and hung like mobiles. In addition, as shown in the display 10' in FIG. 4, the troughs 20*a'*, 20*b'* and lamps 30' could be designed such that the graphics contact pads are located at the top of the lamps. Thus, the lamps could be inserted into the trough in suspended fashion, thereby increasing outdoor lamp applications, as rainwater and other moisture penetration would be minimized.

Figure 5A:
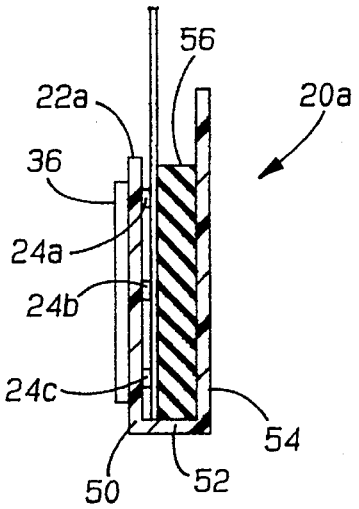
FIGS. 5A–5B are cross-sectional views of two preferred embodiments of the display trough taken along line 5—5 in FIG. 3.

FIG. 5A illustrates a side cross-sectional view of the U-shaped trough 20*a* taken along line 5—5 in FIG. 3. As shown, the trough 20*a* includes a front wall 50, a bottom wall 52 and a rear wall 54. The rear wall 54 is greater in height than the front wall to allow the rear wall to be more easily mounted to the letter board 12. A pressure pad 56 is permanently affixed within the trough along the rear wall 54. The pressure pad is preferably a non-rigid substance such as a closed cell neoprene, a soft rubber or any other non-conductive material.

As shown in FIG. 5A, the bus wires 24*a*–24*c* are affixed to the inner surface of the front wall 50 and are longitudinally spaced apart from one another by a distance corresponding to the longitudinal spacing of the contact pads 44*a*, 44*b*. Thus, the EL lamp contact pads 44*a*, 44*b*, when the EL lamp 30 is inserted into the U-shaped trough 20*a* to a predetermined depth, electrically contacts two of the bus wires 24*a*–24*c*. This electrical contact is maintained through an interference fit of the EL lamp 30 between the pressure pad 56 and the bus wires 24*a*–24*c*. While the pressure pad and the bus wires provide an interference fit of the EL lamp 30 within the trough 20*a*, the EL lamp 30 may be easily withdrawn from this position and may be reinserted into contact with two of the bus wires 24*a*–24*c* at any point along the length of the bus bar 22*a*.

It should be appreciated that the above-described feature represents an improvement over prior lamp connections in which the lamp must be positioned according to the location of an electrical socket or receptacle. With the EL display of the present invention, an EL lamp 30 may be freely electrically connected to the power source at any point along the continuous length of the bus bar without the need for electrical sockets or receptacles. It should also be appreciated that the contacts pads 44*a*, 44*b* are longitudinally offset from one another on the lamp to minimize the likelihood of both contact pads contacting a common bus wires and thus short-circuiting the entire display.

Figure 5B:
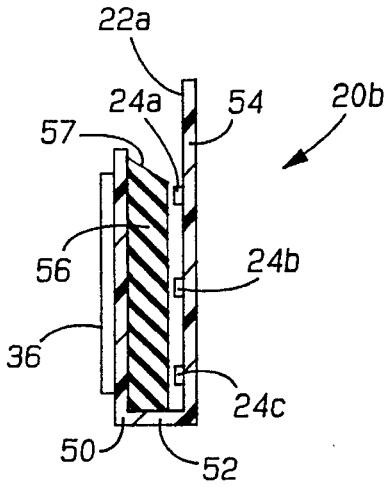

FIG. 5B shows an alternate embodiment 20*b* of the trough 20*a* of FIG. 5A. The configuration of the bus bar 22*a* is identical to that of the bus bar shown in FIG. 5A, with the exception being that the pressure pad 56 is mounted to the front wall 50 of the U-shaped trough, while the bus wires 24*a*–24*c* are mounted to the rear wall 54 of the trough. In addition, pressure pad 56 includes an angled upper edge 57 that facilitates ease of insertion of the EL lamp 30 into contact with the bus bar. Other than the aforementioned structural differences, the function of the trough 20*b* is identical to that shown in FIG. 5A.

Figure 6A:
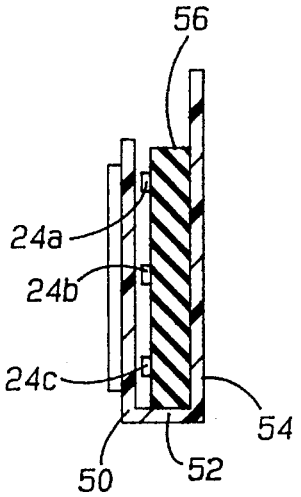
FIGS. 6A–6B are cross-sectional views of additional preferred embodiments of the display trough shown in FIGS. 5A–5B.
Figure 6B:
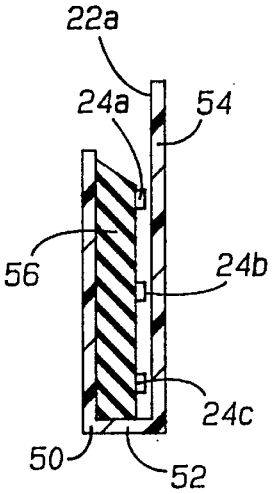

FIGS. 6A–6B show cross-sectional views of two other alternate embodiments of the U-shaped trough according to the present invention. The respective functions of the troughs 20*c* and 20*d* are identical to that of the trough 20*a* shown in FIG. 5A. However, their structure varies in that the bus wires 24*a*24*c* are mounted directly to the pressure pad 56 rather than the front or rear walls 50, 54, respectively. With the trough shown in FIGS. 6A and 6B, an EL lamp 30 is inserted into the troughs and maintained in electrical contact with two of the three bus wires 24*a*–24*c* in an interference fit as described earlier in correspondence with the U-shaped trough 20*a*. Thus, it should be appreciated that the actual structure of the letter board 12 and the bus bars 22*a*, 22*b* may vary according to specific design parameters and application needs without altering the actual bus bar function.

Figure 7:
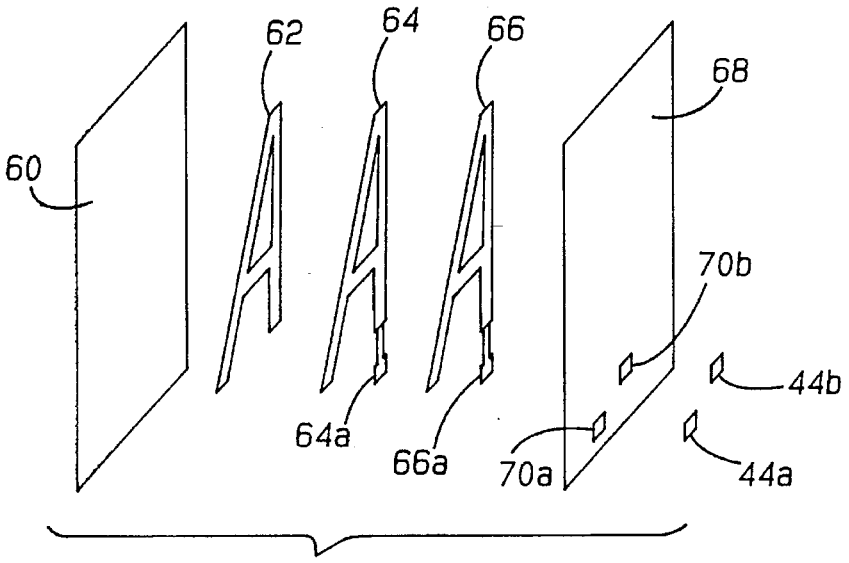
FIG. 7 is an exploded view of the EL lamp according to the present invention.

Referring now to FIG. 7, the process of manufacturing an EL lamp 30 according to the preferred embodiment of the present invention will now be described. The EL lamp is manufactured as a lossy capacitor and is thus illuminated by the discharge of a dielectric material contained between two conductive plates. The lamp 30 includes a base layer of polyester film 60 approximately 0.007 inches in thickness. This base layer of polyester film 60 is sputter coated on one side with a thin conductive layer of indium tin oxide (ITO). Sputter coated polyester film rolls are commercially available and are well known in the art. The ITO coated polyester film layer functions as the first conductive plate of the EL lamp as will be described in detail below. Next, a layer of illuminative material 62, such as a phosphor matrix, is screen printed in desired graphics form onto the ITO coated side of the base layer 60.

Subsequent to the illuminative material layer 62 being screen printed onto the ITO coated side of the film 60, an insulative layer 64 of material such as barium titanate is then applied in the same graphics form as the phosphor matrix layer 62. An insulative material such as barium titanate is preferable due to its high dielectric constant. This high dielectric constant facilitates charge buildup/discharge and thus lamp illumination as described below. However, any other material exhibiting good insulation characteristics and a high dielectric constant may also be used.

Subsequent to the insulative layer 64 being screen printed over the phosphor matrix layer 62, a conductive ink coating 66 is then screen printed on top of the insulative layer 64 in the same graphics form as the layers 62 and 64, with the exception that the conductive ink coating layer graphics form is screen printed in inlaid fashion onto the insulative layer 64 to prevent contact with the ITO coated side of the base layer 60. The layer 66 also includes a conductive via 66*a* for contact with the conductive contact pad 44*b* screen printed in inlaid fashion over the insulative leg 64*a*. The conductive ink coating layer 66 functions as the second conductive plate for the EL lamp 30 as will be described in detail below.

Finally, a second insulative layer 68 is applied over the layers 62, 64, and 66 to effectively seal these layers in a water-tight and air-tight manner between it and the base layer 60. The insulative layer 68 is applied not in the graphics form as are layers 62, 64, 66, but rather is applied across the entire dimension of the base layer 60.

Apertures 70*a*, 70*b* are formed in the insulative layer 68 either prior to or subsequent to application of the insulative layer 68, depending upon the particular manufacturing sequence used. A layer of conductive ink is then screen printed over the two apertures 70*a*, 70*b*. The ink is overprinted slightly onto the insulative layer 68 so as to entirely cover the apertures 70*a*, 70*b*. This layer of conductive ink thus forms discrete coplanar conductive contact pads 44*a*, 44*b*. In final manufactured form, the total overall thickness of the EL lamp 30 is approximately 0.01 inches.

Figure 8:
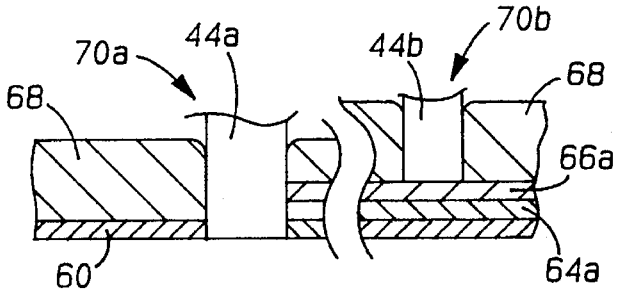
FIG. 8 is a cross-sectional view of the EL lamp shown in FIG. 3 taken along line 8—8.

FIG. 8 is a cross-sectional view of the EL lamp 30 shown in FIG. 3, with the left side being a cross-section through the conductive contact pad 44*a* and the right side being a cross-section of the lamp through electric conductive contact 44*b*. As shown in the cross-section of contact pad 44*a*, the pad is formed longitudinally below the layers 62, 64, 66 on the lamp and thus does not electrically contact any of these layers. Rather, the contact pad 44*a* extends through the aperture 70*a* and the insulative layer 68 into electrical contact with the ITO coated side of the base layer 60.

Referring to the right side of FIG. 8, the conductive contact pad 44*b* extends through the aperture 70*b* and the insulative layer 68 into electrical contact with the conductive via 66*a*. The conductive contact pad 44*b* and conductive via 66*a* are electrically insulated from the ITO coated surface of the base layer 60 and the illuminative material layer 62 by the non-conductive leg 64*a* formed from the layer of insulative material 64. Because of the presence of the non-conductive leg 64*a* and the conductive via 66*a*, the right side is thicker than the left side at the contact pad locations as shown.

Thus, in summary, the layer of illuminative material 62 electrically contacts the conductive pad 44*a* through the ITO coated surface of the base layer 60, while the conductive ink layer 66 electrically contacts the contact pad 44*b* through the conductive via 66*a*.

The multi-layer EL lamp, when energized through electrical contact with bus wires 24*a*, 24*b* or 24*b*, 24*c*, is illuminated through the capacitive effect created by the dielectric material (the barium titanate), the first conductive plate (the ITO coated surface of the base layer 60) and the second conductive plate (the conductive ink layer 68). In particular, as both the ITO coated surface of the first layer and the second insulative layer 68 are energized, the electric field created between the two plates illuminates the phosphor matrix material 62.

Figure 9:
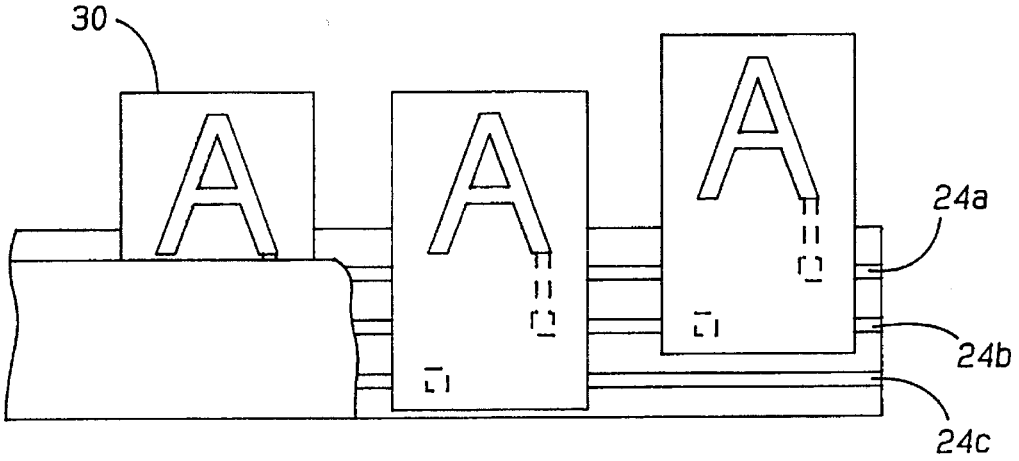
FIG. 9 is a front elevational view of EL lamps of the present invention operatively inserted into electrical contact with the bus bar of the present invention in two alternate operative positions.

It should be appreciated at this point that the EL lamp is positioned within the U-shaped trough with either the base layer 60 or the insulative layer 68 functioning as the lamp appearance side, depending upon the location of the bus wires and the orientation of the lamp graphics. For example, if the bus wires 24*a*–24*c* are mounted to the front side 50 as shown in FIG. 5A or to the pressure pad 56 as shown in FIG. 6B, the EL lamp 30 must be manufactured such that the EL lamp graphics are correctly oriented. In such a configuration, the insulative surface 68 functions as the lamp appearance surface and the conductive contact pads 44*a*, 44*b* electrically contact the bus wires from the appearance side of the lamp as with the lamp shown in FIG. 3. Alternately, if the bus wires are mounted to the rear face 54 as shown in FIG. 5*b* or to the pressure pad as shown in FIG. 6A, the graphics of the EL lamp 30 must be configured such that when the lamp 30 is inserted into the U-shaped trough, the base layer 60 functions as the appearance side and the contact pads 44*a*, 44*b* electrically connect the lamp to the bus wires through the insulative layer 68 on the non-appearance side of the lamp. FIG. 9 illustrates the latter configuration with the base layer 60 functioning as the appearance surface and the contact pads 44*a*, 44*b* protruding from the insulative layer 68 to electrically contact the bus wires 24*a*, 24*b* mounted to the pressure pad 56.

Additionally, as shown in FIG. 9, bus bars 22*a*, 22*b* may have three or more bus wires to enable the EL lamp 30 to have alternate lighting features, such as steady illumination, flashing or running features. For example, referring to FIG. 9, if the lamp 30 is inserted into the U-shaped trough such that the contact pad 44*a* electrically contacts the bus wire 24*c* and the electrical contact pad 44*b* electrically contacts the bus wire 24*b*, the lamp graphics are lit in a flashing manner. However, if the lamp 30*b* in FIG. 9 is inserted into the U-shaped trough such that the contact pad 44*a* electrically contacts bus wire 24*b* and the contact pad 44*b* electrically contacts bus wire 24*a*, the EL lamp graphics is steadily illuminated. The interference fit of the lamp in the U-shaped trough, in combination with the slight protrusion of the bus wires, holds the lamp in either of the above positions. Lamp positions may be easily changed through application of a small amount of force, either downwardly or upwardly, depending upon the desired illumination effect, to thereby urge the lamp past the particular protruding bus wires and into contact with the desired pair of bus wires. If an additional feature is desired, such as a racing effect, an additional bus wire or wires may be added to the bus bars to allow the EL lamps 30 to be inserted to a third position bus bar to cause such an illumination feature.

It should be appreciated that the EL display of the present invention may be used for a wide variety of graphics and sign applications. Such applications include, but are not limited to, drive-in window displays, greeting cards, bulletin boards, restaurant menus, billboards, displays such as those mounted to the sides of moving vehicles, and numerous other movable or stationary sign configurations.

While the above description constitutes the preferred embodiment of the present invention, it should be appreciated that the invention may be modified without departing from the proper scope or fair meaning of the accompanying claims. Various other advantages of the present invention will become apparent to those skilled in the art after having the benefit of studying the foregoing text and drawings taken in conjunction with the following claims.

I claim:

1. A lighted electroluminescent display, comprising:

a display support;

a power supply in electrical communication with said display support;

a bus bar mounted to said display support and having at least two bus wires extending therealong, said bus wires being electrically connected to said power supply;

an electroluminescent lamp in electrical communication with said bus bar, said electroluminescent lamp having substantially coplanar bus wire contact pads and being illuminated by electricity supplied by said power source to said contact pads through said bus wires;

said bus bar including a pressure pad mounted to one side thereof, said bus wires being mounted on said pressure pad to urge said lamp into electrical contact therewith.

2. The lighted electroluminescent display of claim 1, wherein said electroluminescent lamp comprises:

a base nonconductive film having an electrically conductive coating;

a first layer of illuminative material screen printed onto said base film over a defined area;

a second layer of insulative material applied over said first layer of illuminative material;

a third layer of conductive material screen printed over said second layer of insulative material and inset from peripheral edges of said first and second layers;

an insulative coating applied over said third layer of conductive material; and first and second coplanar conductive contact pads longitudinally offset from one another for electrically connecting said electroluminescent lamp to said power supply, said first electrical conductive contact pad connecting said base film having said conductive coating to said power supply, said second electrically conductive contact pad connecting said conductive material to said power supply.

3. The lighted electroluminescent display of claim 2, wherein said base film having a conductive coating comprises a polyester film coated with an indium tin oxide.

4. The lighted electroluminescent display of claim 2, wherein said illuminative material comprises a phosphor matrix.

5. The lighted electroluminescent display of claim 2, wherein said second layer of insulative material coating said illuminative material applied over said first layer comprises a barium titanate layer.

6. The lighted electroluminescent display of claim 2, wherein said conductive material comprises a silver ink layer.

7. The lighted electroluminescent display of claim 2, wherein said first and second conductive contact pads comprise first and second silver conductive ink pad print layers.

8. The lighted electroluminescent display of claim 2, wherein said bus bar further comprises a third bus wire extending therealong and electrically connected to said power supply.

9. The electroluminescent display of claim 8, wherein electrical contact between said first and second contacts with said first and second bus wires causes constant illumination of said electroluminescent lamp, and electrical connection between said first and second electrical contacts with said second and third bus wires causes flashing of said electroluminescent lamp.

10. The electroluminescent display of claim 9, wherein said electroluminescent lamp is continuously electrically connectable to said bus wires.

11. The lighted electroluminescent display of claim 1, wherein said bus wires are substantially coplanar with one another.

12. A lighted electroluminescent display, comprising:

a display support;

a power supply in electrical communication with said display support;

an electroluminescent lamp, comprising:

a base nonconductive film having an electrically conductive coating;

a first layer of illuminative material screen printed onto said base film over a defined area;

a second layer of insulative material applied over said first layer of illuminative material;

a third layer of conductive material screen printed over said second layer of insulative material and inset from peripheral edges of said first and second layers;

an insulative coating applied over said third layer of conductive material;

first and second coplanar conductive contact pads longitudinally offset from one another for electrically connecting said electroluminescent lamp to said power supply, said first electrical conductive contact pad connecting said base film having said conductive coating to said power supply, said second electrically conductive contact pad connecting said conductive material to said power supply; and a bus bar mounted to said display support and having at least two bus wires extending therealong, said bus wires being electrically connected to said power supply, said bus bar including a pressure pad mounted to one side thereof, said bus wires being mounted on said pressure pad to urge said lamp into electrical contact therewith.

13. A lighted electroluminescent display, comprising:

a display support;

a power supply in electrical communication with said display support;

a bus bar mounted to said display support and having first, second and third vertically spaced bus wires extending therealong, said first, second and third bus wires being electrically connected to said power supply; and an electroluminescent lamp in electrical communication with said bus bar, said electroluminescent lamp having substantially coplanar bus wire contact pads and being illuminated by electricity supplied by said power source to said contact pads through said bus wires;

said first and second bus wires continuously illuminating said electroluminescent lamp when said bus wire contact pads are contacted therewith, said second and third bus wires intermittently illuminating said electroluminescent lamp when said contact pads are contacted therewith.

14. A lighted electroluminescent display, comprising:

a display support;

a power supply in electrical communication with said display support;

a bus bar mounted to said display support and having multiple vertically spaced bus wires extending therealong, said bus wires being electrically connected to said power supply; and an electroluminescent lamp in electrical communication with said bus bar, said electroluminescent lamp having substantially coplanar bus wire contact pads and being illuminated by electricity supplied by said power source to said contact pads through said bus wires;

said display support defining a single channel trough including a pressure pad therein for receiving a portion of said electroluminescent lamp to maintain said lamp in a display position, said pressure pad urging said contact pads into electrical contact with said bus wires.

* * * * *